US011891884B2

(12) United States Patent
Wilson

(10) Patent No.: US 11,891,884 B2
(45) Date of Patent: Feb. 6, 2024

(54) ELECTRO-HYDRAULIC HIGH-PRESSURE OILFIELD PUMPING SYSTEM

(71) Applicant: Twin Disc, Inc., Racine, WI (US)

(72) Inventor: Edwin E. Wilson, Colleyville, TX (US)

(73) Assignee: Twin Disc, Inc., Racine, WI (US)

( * ) Notice: Subject to any disclaimer, the term of this patent is extended or adjusted under 35 U.S.C. 154(b) by 150 days.

(21) Appl. No.: 17/603,369

(22) PCT Filed: Apr. 17, 2020

(86) PCT No.: PCT/US2020/028725

§ 371 (c)(1),
(2) Date: Oct. 13, 2021

(87) PCT Pub. No.: WO2020/214934

PCT Pub. Date: Oct. 22, 2020

(65) Prior Publication Data

US 2022/0251936 A1 Aug. 11, 2022

Related U.S. Application Data

(60) Provisional application No. 62/835,348, filed on Apr. 17, 2019.

(51) Int. Cl.

| | |
|---|---|
| ***E21B 43/26*** | (2006.01) |
| ***F04B 17/03*** | (2006.01) |
| ***F04B 23/06*** | (2006.01) |
| ***F04B 49/06*** | (2006.01) |

(52) U.S. Cl.

CPC ..... *E21B 43/2607* (2020.05); *E21B 43/26* (2013.01); *F04B 17/03* (2013.01); *F04B 23/06* (2013.01); *F04B 49/065* (2013.01)

(58) Field of Classification Search

CPC ..... E21B 43/2607; E21B 43/26; F04B 17/03; F04B 23/06; F04B 49/065; F04B 9/02; F04B 9/10; F04B 15/02; F04B 49/06; F04D 13/12

See application file for complete search history.

(56) References Cited

U.S. PATENT DOCUMENTS

| | | | |
|---|---|---|---|
| 10,221,856 | B2 | 3/2019 | Hernandez et al. |
| 2008/0182699 | A1 | 7/2008 | Salvaire et al. |
| 2014/0010671 | A1 | 1/2014 | Cryer et al. |

(Continued)

FOREIGN PATENT DOCUMENTS

| | | |
|---|---|---|
| CN | 101702602 | 11/2011 |
| CN | 205876701 | 1/2017 |

(Continued)

*Primary Examiner* — James G Sayre
(74) *Attorney, Agent, or Firm* — Boyle Fredrickson S.C.

(57) ABSTRACT

An electro-hydraulic high-pressure oilfield pumping system includes a fracturing (frac) pump and a primary electric motor as a prime mover that delivers power to the frac pump. The primary electric motor may be a constant speed AC (alternating current) motor. A hydraulic starting motor may rotate a shaft of the primary electric motor to achieve or approximate its fixed rated speed before the primary electric motor is energized. A slow frac hydraulic motor may rotate the shaft of the primary electric motor as a passive torque transmission device that delivers power in a downstream direction through a transmission and to the frac pump.

18 Claims, 4 Drawing Sheets

(56) References Cited

U.S. PATENT DOCUMENTS

| | | | | |
|---|---|---|---|---|
| 2017/0051732 | A1* | 2/2017 | Hemandez | F04B 17/06 |
| 2017/0114625 | A1 | 4/2017 | Norris et al. | |
| 2017/0234308 | A1 | 8/2017 | Buckley | |
| 2018/0334891 | A1 | 11/2018 | Markovitch et al. | |
| 2019/0154020 | A1* | 5/2019 | Glass | F04B 15/02 |

FOREIGN PATENT DOCUMENTS

| | | |
|---|---|---|
| WO | 2015192003 | 12/2015 |
| WO | 2019060922 | 3/2019 |

* cited by examiner

ELECTRO-HYDRAULIC HIGH-PRESSURE OILFIELD PUMPING SYSTEM

CROSS REFERENCE TO RELATED APPLICATIONS

This application claims the benefit of priority under 35 USC § 119(e) to U.S. Provisional Patent Application No. 62/835,348, filed Apr. 17, 2019, the entire contents of which are hereby expressly incorporated by reference into the present application.

BACKGROUND OF THE INVENTION

Field of the Invention

The preferred embodiments relate generally to the field of hydrocarbon recovery from the earth and, more specifically, to oilfield pressure pumping systems for fracturing underground formations to enhance recovery of hydrocarbons.

Discussion of the Related Art

Hydraulically fracturing subterranean formations with oilfield pressure pumping systems to enhance flow in oil and gas wells is known. Hydraulic fracturing increases well productivity by increasing the porosity of, and thus flow rate through, production zones that feed boreholes of the wells that remove underground resources like oil and gas.

Oilfield pressure pumping systems include heavy-duty industrial-type components to create the extreme hydraulic pressures, for example, 10,000 psi or more, which are needed to fracture the subterranean geological formations. Positive displacement, high pressure, plunger pumps are used as fracturing (fracking or frac) pumps to generate the extreme hydraulic pressures that are capable of fracturing subterranean geological formations.

Flow and pressure of frac fluids from frac pumps must be closely regulated at the various fracturing stages in order to adequately control the fracturing process. Accordingly, prime movers that deliver power to the frac pumps are variable speed devices, since driving the frac pumps at variable speeds at least partially provides the flow and pressure control.

Typically, the prime movers are high horsepower stationary diesel engines that deliver power to the frac pumps through multi-speed gearboxes or transmissions. High horsepower stationary diesel engines are expensive and require maintenance and operational attention, such as refueling.

Other attempts have been made to use variable speed electric motors to power frac pumps. Variable speed electric motors are able to vary flow and pressure of the frac pumps through speed-varying motor controls, which facilitates control of the fracturing operation. Variable speed electric motors either directly drive the frac pumps at the motors' variable speeds or with an intervening single-speed gearbox or transmission. Such variable speed electric motors include shunt wound, variable speed, DC (direct current) traction motors and variable speed, for example, variable frequency, AC (alternating current) electric motors. Although variable speed electric motors can require less operational attention than high horsepower stationary diesel engines, they are expensive and require sophisticated motor controls.

Constant speed AC motors are more straightforward than variable speed electric motors but have not been used to deliver power to frac pumps. That is because the fixed speed(s) of constant speed AC motors do not provide the desired amount of flow and pressure control of the frac pumps to allow operators to suitably control the fracturing operation. Typical multi-speed gearboxes are unable to resolve this problem with constant speed AC motors because they are unable to shift under full load and have range ratios that are ill-suited to provide a sufficient variety of output shaft speeds or corresponding frac pump flow and pressure control.

Furthermore, constant speed AC motors of high-enough horsepower ratings to power frac pumps are difficult to start because they require extremely high starting currents as in-rush (locked rotor) currents to begin their rotations.

What is therefore needed is a prime mover for high pressure pumping applications, like powering frac pumps, employing a constant speed AC motor, but without the above-noted drawbacks primarily directed to flow and pressure control.

SUMMARY AND OBJECTS OF THE INVENTION

The preferred embodiments overcome the above-noted drawbacks by providing an electro-hydraulic high-pressure pumping system that incorporates a constant speed AC motor. This can be incorporated as an electro-hydraulic frac pump system for use in an oilfield pressure pumping system.

An electro-hydraulic high-pressure oilfield pumping system includes a fracturing (frac) pump and a primary electric motor as a prime mover that delivers power to the frac pump. The primary electric motor may be a constant speed AC (alternating current) motor. A hydraulic starting motor may rotate a shaft of the primary electric motor to achieve or approximate its fixed rated speed before the primary electric motor is energized. A slow frac hydraulic motor may rotate the shaft of the primary electric motor as a passive torque transmission device that delivers power in a downstream direction through a transmission and to the frac pump.

The system may define multiple modes of operation. In a primary electric motor starting mode, a hydraulic starting motor delivers power through the transmission to rotate the motor shaft of the primary electric motor to its fixed rated speed before being energized, which allows the primary electric motor to be started at essentially its normal running current instead of at a high in-rush starting current. In a slow frac mode, a slow frac hydraulic motor delivers power through the transmission to rotate the motor shaft of the primary electric motor to a speed that is less than the fixed rated speed to the primary electric motor to drive the frac pump at a slower speed and provide high-pressure slow speed fracking. In a frac mode, the primary electric motor is energized and delivers power to the transmission into the frac pump.

According to a first embodiment, an electro-hydraulic high-pressure oilfield pumping system for driving a fracturing (frac) pump is configured to pressurize a frac fluid for delivery into a well that extends into a subterranean geological formation. The system includes a primary electric motor that has a motor shaft and defines a prime mover of the electro-hydraulic high-pressure oilfield pumping system. In addition, the system preferably employs a transmission with multiple ranges that provide multiple drive ratios, the transmission being arranged between and configured to deliver power from primary electric motor to the frac pump. A starting motor selectively delivers power through the transmission to rotate the motor shaft of the primary electric motor.

In another aspect of this embodiment, the primary electric motor is a constant speed AC motor that defines a fixed rated speed, and moreover, the hydraulic starting motor is configured to rotate at a speed that corresponds to the fixed rated speed of the primary electric motor.

According to a further aspect of this embodiment, a slow frac motor is provided to selectively deliver power through the transmission to rotate the motor shaft of the primary electric motor. The primary electric motor is a constant speed AC motor that defines a fixed rated speed, and the slow frac motor is configured to rotate at a speed that is less than the fixed rated speed of the primary electric motor.

In another embodiment, an electro-hydraulic high-pressure oilfield pumping system includes a fracturing (frac) pump configured to pressurize a frac fluid for delivery into a well that extends into a subterranean geological formation, and a primary electric motor that has a motor shaft and defines a prime mover of the electro-hydraulic high-pressure oilfield pumping system. A transmission with multiple ranges provides multiple drive ratios and is arranged between and configured to deliver power from primary electric motor to the frac pump. A hydraulic starting motor selectively delivers power through the transmission to rotate the motor shaft of the primary electric motor, and a slow frac hydraulic motor selectively delivers power through the transmission to rotate the motor shaft of the primary electric motor. Also, a hydraulic power pack is configured to selectively permit or prevent flow of hydraulic fluid to each of the hydraulic starting motor and the slow frac hydraulic motor to activate or deactivate the hydraulic starting motor and the slow frac hydraulic motor.

According to another embodiment, a method of fracking a subterranean formation using a primary electric motor includes the step of driving the primary electric motor with a starting motor and driving a frac pump with an output of the primary electric motor to facilitate fracking the subterranean formation. The method further includes selectively delivering power from the primary electric motor to the frac pump using a transmission.

In another aspect of this embodiment, the method further includes the step of, in a starting mode, energizing the hydraulic motor with a second electric motor, and rotating a motor shaft of the primary electric motor with the hydraulic motor to a first speed that corresponds to a fixed rated speed of the primary electric motor. Preferably, the primary electric motor is a constant speed AC motor. Moreover, the method includes the step of, in a slow frac mode, energizing a slow frac hydraulic motor with a third electric motor. The slow frac hydraulic motor selectively delivers power through the transmission to rotate the motor shaft of the primary electric motor to a second speed that is less than the fixed rated speed of the primary electric motor.

These, and other aspects and objects of the present invention, will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical embodiments of the present invention, will become more readily apparent by referring to the exemplary and, therefore, non-limiting, embodiments illustrated in the drawings accompanying and forming a part of this specification, wherein like reference numerals designate the same elements in the several views, and in which.

Figure 1:
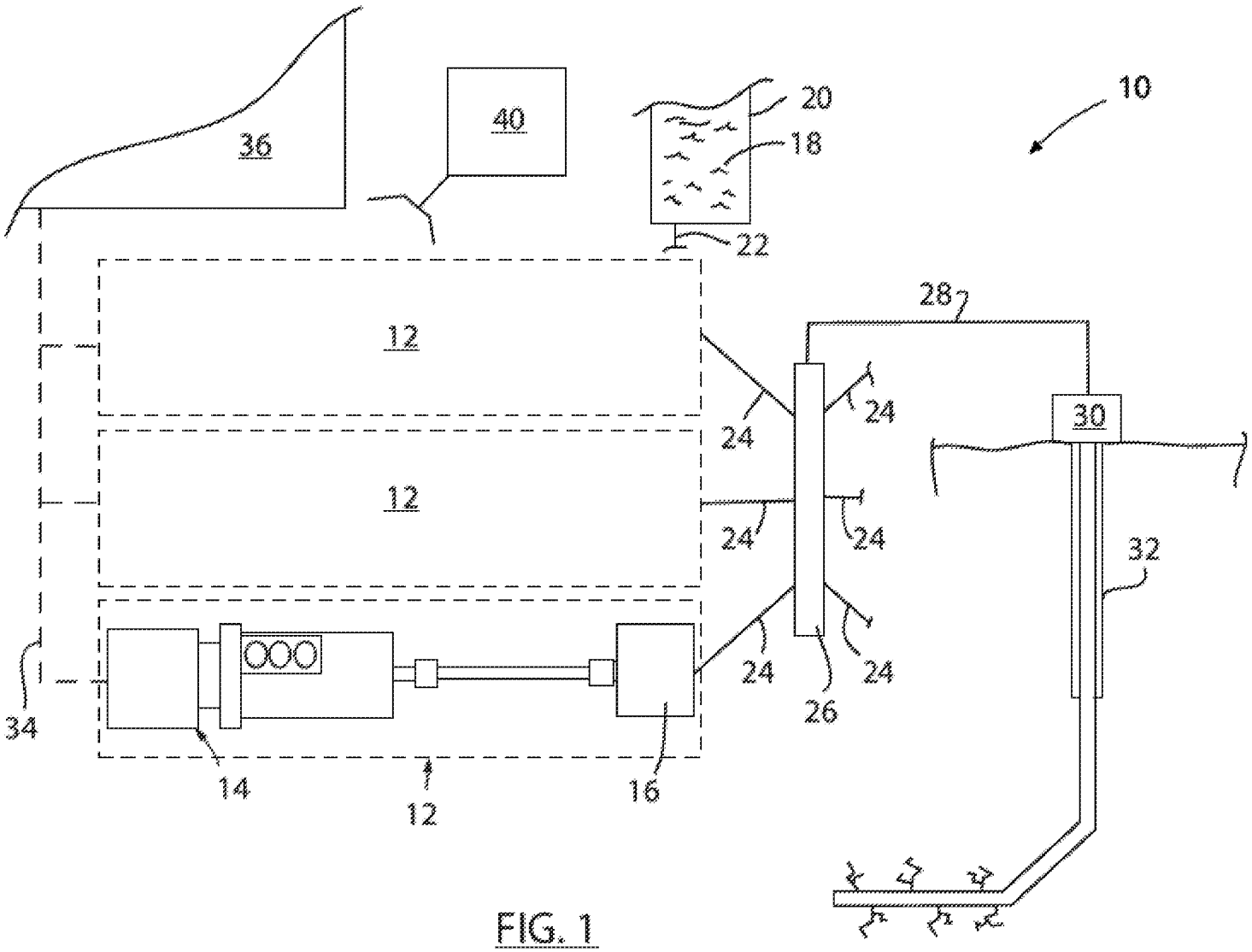
FIG. 1 is a schematic illustration of an oilfield pressure pumping system incorporating electro-hydraulic high-pressure pumping systems, shown incorporated as a frac pump system, according to a preferred embodiment.

In describing preferred embodiments of the invention, which are illustrated in the drawings, specific terminology will be resorted to for the sake of clarity. However, it is not intended that the invention be limited to the specific terms so selected, and it is to be understood that each specific term includes all technical equivalents, which operate in a similar manner to accomplish a similar purpose. For example, the words "connected", "attached", "coupled", or terms similar thereto are often used. They are not limited to direct connection but include connection through other elements where such connection is recognized as being equivalent by those skilled in the art.

DETAILED DESCRIPTION OF PREFERRED EMBODIMENTS

Referring to FIG. 1, one embodiment of the invention is shown as an electro-hydraulic high-pressure pumping system 10. The electro-hydraulic high-pressure pumping system 10 is shown here implemented as an electro-hydraulic frac pumping system 12, which includes an electro-hydraulic drive system 14 that delivers power to a fracturing pump or frac pump 16. Frac pump 16 can be a positive displacement, high-pressure, plunger pump or other suitable pump that can deliver high flow rates and produce high pressures, for example, 10,000 psi or more. This oilfield site is shown with multiple electro-hydraulic frac pumping systems 12 that operate together for a subterranean geological formation fracturing or fracking operation to stimulate well production. The electro-hydraulic frac pumping systems 12 can be activated or brought online and implemented separately or together, depending on the particular pumping needs for a given fracking operation or operational stage. Each of the electro-hydraulic frac pumping systems 12 may define a singularly-packaged unit, for example, mounted on a trailer that can be towed by a semi-tractor or other tow vehicle. Each frac pump 16 receives fracturing fluid or frac fluid 18 that is stored in a frac fluid storage system 20 and delivers the frac fluid 18 to the frac pumps 16 through frac fluid delivery lines 22. Pressurized frac fluid 18 is delivered from the frac pumps 16, through manifold delivery lines 24, to manifold 26 that delivers the pressurized frac fluid 18 through manifold outlet line 28 to wellhead 30. At the wellhead 30, the frac fluid 18 is directed to flow through a borehole that extends through a well casing 32 for fracturing the subterranean formation.

Still referring to FIG. 1, electro-hydraulic frac pumping system 12 selectively receives electrical power through conductors 34 from electrical power system 36. Electrical power system 36 includes a generator and prime mover such as a combustion engine which may be a gas turbine engine. Control system 40 includes a computer that executes various stored programs while receiving inputs from and sending commands to the electro-hydraulic frac pumping system 12 for controlling, for example, energizing and de-energizing various system components as well as bringing the electro-hydraulic frac pumping system 12 online for fracking the subterranean formations by controlling the various electronic, electromechanical, and hydraulic systems and/or other components of each electro-hydraulic frac pumping system 12. Frac site control system 40 may include the TDEC-501 electronic control system available from Twin Disc®, Inc. for controlling the electro-hydraulic frac pumping system(s) 12.

Figure 2:
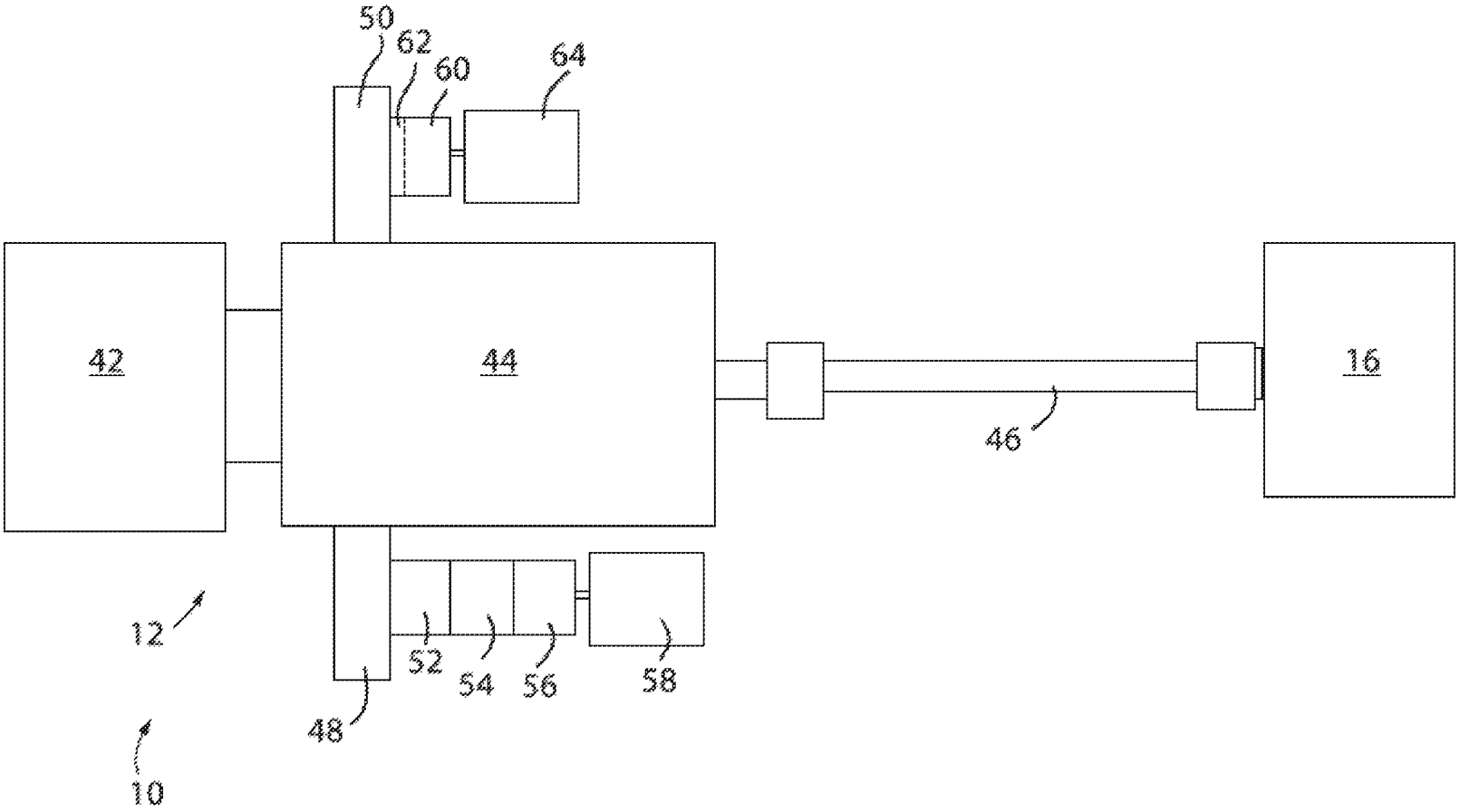
FIG. 2 is a schematic illustration of an oilfield pressure pumping system incorporating electro-hydraulic high-pressure pumping systems, shown incorporated as a frac pump system, according to another preferred embodiment.

Referring now to FIG. 2, electro-hydraulic frac pumping system 12 includes a constant speed AC motor, shown as primary electric motor 42. Primary electric motor 42 is a high-powered constant speed motor, for example, about 1,000 HP (horsepower) or having an equivalent torque rating of about a 1,000 HP diesel engine. Primary electric motor 42 operates at a relatively fast fixed rotational speed, such as a fixed rated speed of about 3,000 RPM (rotations per minute). Primary electric motor 42 is connected and delivers power to a heavy-duty industrial gearbox or transmission, shown as transmission 44. Transmission 44 may be a multi-speed transmission with multiple ranges that provide multiple substantially evenly spaced drive ratios to facilitate close regulation of rotational speed of the transmission output shaft and, correspondingly, the frac pump's 16 operational speed and output flow and pressure. Transmission 44 may be, for example, a model TA90-7600, available from Twin Disc®, Inc., which is capable of changing ranges while the frac pump 16 is fully loaded. Driveshaft 46 transmits torque from transmission 44 to frac pump 16.

Still referring to FIG. 2, transmission 44 includes a PTO tower or section with a pair of pump pads 48, 50 for mounting and mechanically delivering power to or receiving power from various components, for example, hydraulic components. The lower illustrated pump pad 48 is shown supporting a pair of transmission pumps 52, 54 which may be configured to, for example, supply pressurized oil for transmission lubrication and controlling hydraulically actuated components within the transmission.

Still referring to FIG. 2, a hydraulic starting motor 56 may be a high speed, low torque, hydraulic motor and is shown mounted to the transmission pumps 52, 54, and therefore transmission 44 by way of pump pad 48. Electric motor 58 selectively delivers torque to hydraulic starting motor 56. Electric motor 58 may be a variable speed AC motor that is substantially smaller than primary electric motor 42, with electric motor 58 rated at, for example, about 50 HP. Energizing electric motor 58 activates hydraulic starting motor 56, which rotates various gear train or other components of transmission 44 and correspondingly rotates the shaft of primary electric motor 42 when the primary electric motor 42 is de-energized. In this way, hydraulic starting motor 56 can be activated to rotate primary electric motor 42 shaft to bring it sufficiently close to its rated fixed speed or synchronous speed before the primary electric motor 42 is energized. Hydraulic starting motor 56 can correspondingly rotate at about 3,000 RPM or at an appropriate speed that can rotate the primary electric motor 42 shaft at 3,000 RPM or other speed, depending on the particular rated or synchronous speed of primary electric motor 42. Rotating the primary electric motor 42 with hydraulic starting motor 56 to achieve the synchronous speed of primary electric motor 42 allows connection to the electrical power source DoL (Direct on Line) while avoiding the motor's high in-rush (locked rotor) current that would otherwise be required to start the primary electric motor 42. The primary electric motor 42 is therefore able to be started at essentially its normal running current, when pre-driven to its synchronous speed by hydraulic starting motor 56.

Still referring to FIG. 2, a slow frac hydraulic motor 60 may be configured to, for example, supply slow speed or low flow operation of frac pump 16. Slow frac hydraulic motor 60 may be a low speed, high torque, hydraulic motor that is mounted to pump pad 50. The rotational speed of slow frac hydraulic motor 60 may be a fraction of the rotational speed of hydraulic starting motor 56. Clutch 62 is shown arranged between the slow frac hydraulic motor 60 and pump pad 50 and is configured to disconnect power transfer between the slow frac hydraulic motor 60 and transmission 44. Clutch 62 may be an overrunning clutch or an actuatable or other clutch to passively or actively connect or disconnect power flow between the slow frac hydraulic motor 60 and transmission to correspond to different operational states of the fracking system. It is understood that instead of or in addition to implementing clutch 62, when the slow frac hydraulic motor 60 is not being implemented, it can be locked against activation, which may include binding or holding the pistons in the motor fixed, depending on its configuration.

Electric motor 64 selectively delivers torque to slow frac hydraulic motor 60. Like electric motor 58, electric motor 64 may be a variable speed AC motor that is substantially smaller than primary electric motor 42, with electric motor 64 rated at, for example, about 50 HP. Energizing electric motor 64 activates slow frac hydraulic motor 60, which rotates various gear train or other components of transmission 44 and correspondingly rotates the shaft of primary electric motor 42 when the primary electric motor 42 is de-energized. In this way, the slow frac hydraulic motor 60 can be activated to rotate primary electric motor 42 shaft at slow and precisely controlled speeds to deliver torque through the transmission 44 and correspondingly precisely control the frac pump 16 to provide high-pressure low speed fracking. The rotational speed of slow frac hydraulic motor 60 be between about 800 RPM to 1,100 RPM or at an appropriate speed that can rotate the primary electric motor 42 shaft at between about 800 RPM to 1,000 RPM or other speed, depending on the particular speed required to produce the desired flow rate of frac pump 16 for high pressure low speed fracking. Regardless, the precise slow speed control of slow frac hydraulic motor 60 may be achieved using a closed-loop controller (e.g., proportional integral derivative (PID) controller) within the control system 40 (FIG. 1) that controls rotational speed of electric motor 64 that powers the slow frac hydraulic motor 60.

Figure 3:
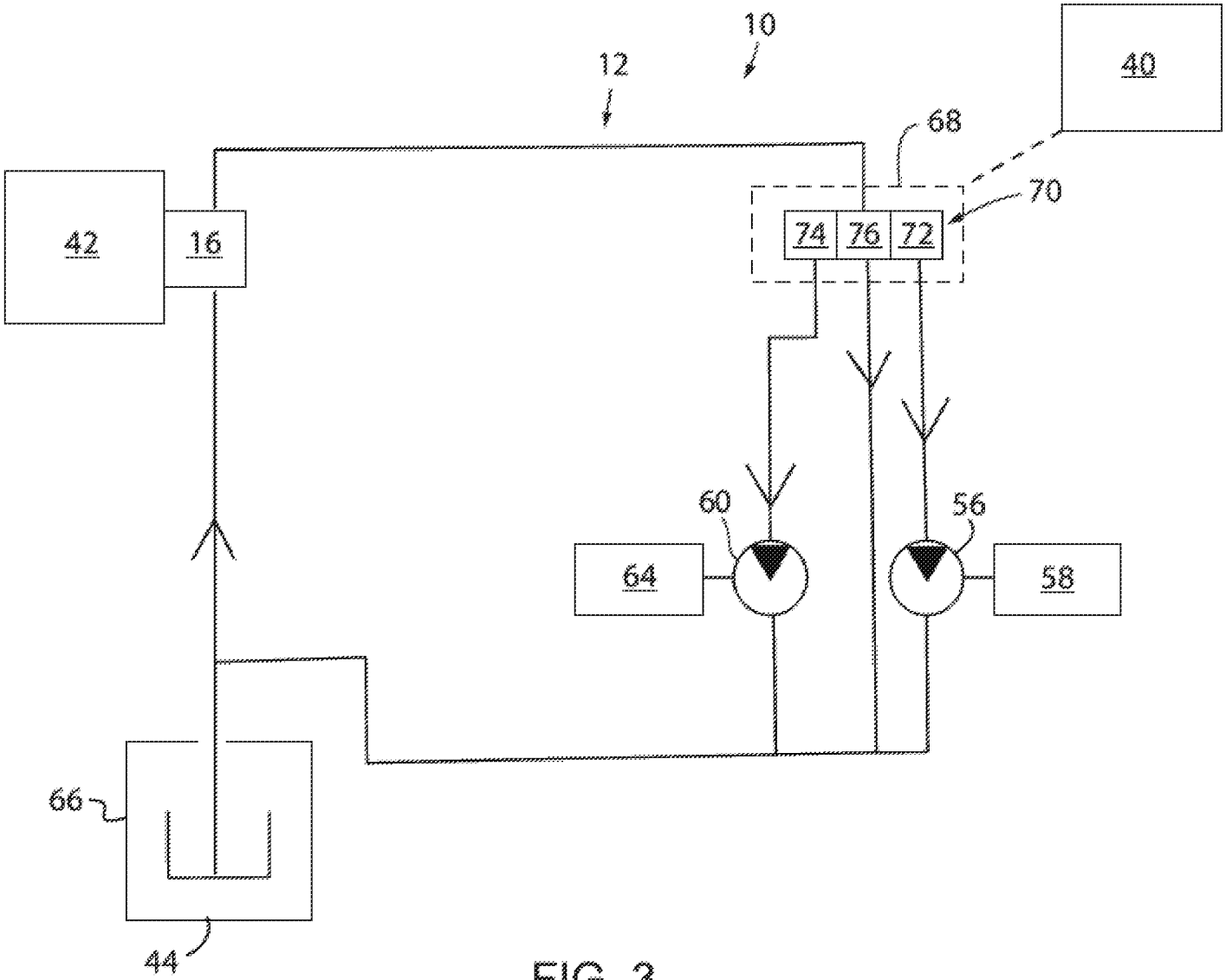
FIG. 3 is a schematic illustration of an oilfield pressure pumping system incorporating electro-hydraulic high-pressure pumping systems, shown incorporated as a frac pump system, according to a further preferred embodiment.

Referring now to FIG. 3, an exemplary simplified hydraulic schematic layout is shown. The hydraulic components of the system 10 share a common tank or sump, shown here as reservoir 66 within transmission 44. Hydraulic power pack 68 controls flow of hydraulic fluid through various components within the system 10. Mode selector valve 70 of hydraulic power pack 68 provides three discrete flow paths of hydraulic fluid out of the hydraulic power pack 68. Mode selector valve 70 may be, for example, a solenoid actuated spool valve that provides three discrete positions, represented as positions 72, 74, and 76, to selectively allow flow out of three corresponding outlets and provide three corresponding flow paths out of the hydraulic power pack 68. Actuating the mode selector valve 70 allows for selectively activating and permitting hydraulic fluid flow through hydraulic starting motor 56, slow frac hydraulic motor 60, or neither.

Still referring to FIG. 3, when mode selector valve 70 is at a first position shown as position 72, hydraulic fluid directed to hydraulic starting motor 56. This defines a primary electric motor starting mode of system 10 in which hydraulic starting motor 56 delivers torque to rotate the shaft of the de-energized primary electric motor 42 to achieve its synchronous speed in preparation for its energization by connecting to the electrical power source DoL.

Next, when mode selector valve 70 is at a second position shown as position 74, hydraulic fluid directed to slow frac hydraulic motor 60. This defines a slow frac mode of system 10 in which slow frac hydraulic motor 60 delivers torque to rotate shaft of the de-energized primary electric motor 42. The corresponding motor shaft is used as a passively driven torque-transmitting component to deliver power from the slow frac hydraulic motor 60 through transmission 44 and to the frac pump 16 to achieve high-pressure, slow speed, fracking in the slow frac mode of system 10.

Still referring to FIG. 3, when mode selector valve 70 is at a third position shown as neutral position 76, hydraulic fluid that would otherwise be directed to hydraulic starting motor 56 or slow frac hydraulic motor 60 is instead directed to tank or reservoir 66 of transmission 44. Selector valve 70 is actuated to or held in this neutral or third position 76 when, for example, primary electric motor 42 is energized and driving frac pump 16 through transmission 44 and shaft 46, which provides normal or default fracking operation as a normal frac mode or frac mode of system 10. During frac mode, selector valve 70 is in its neutral or third position 76 and correspondingly avoids any non-desired pumping through hydraulic starting motor 56 or slow frac hydraulic motor 60 by preventing flow to or through the hydraulic starting motor 56 or slow frac hydraulic motor 60. Such inadvertent passive pumping can be yet further prevented with respect to slow frac hydraulic motor 60 by, for example, clutch 62 (FIG. 2) that either allows the rotating mechanism (s) of pump pad 50 to overrun the slow frac hydraulic motor 60 or disengage a selective driving engagement between the pump pad 50 and the slow frac hydraulic motor 60.

Figure 4:
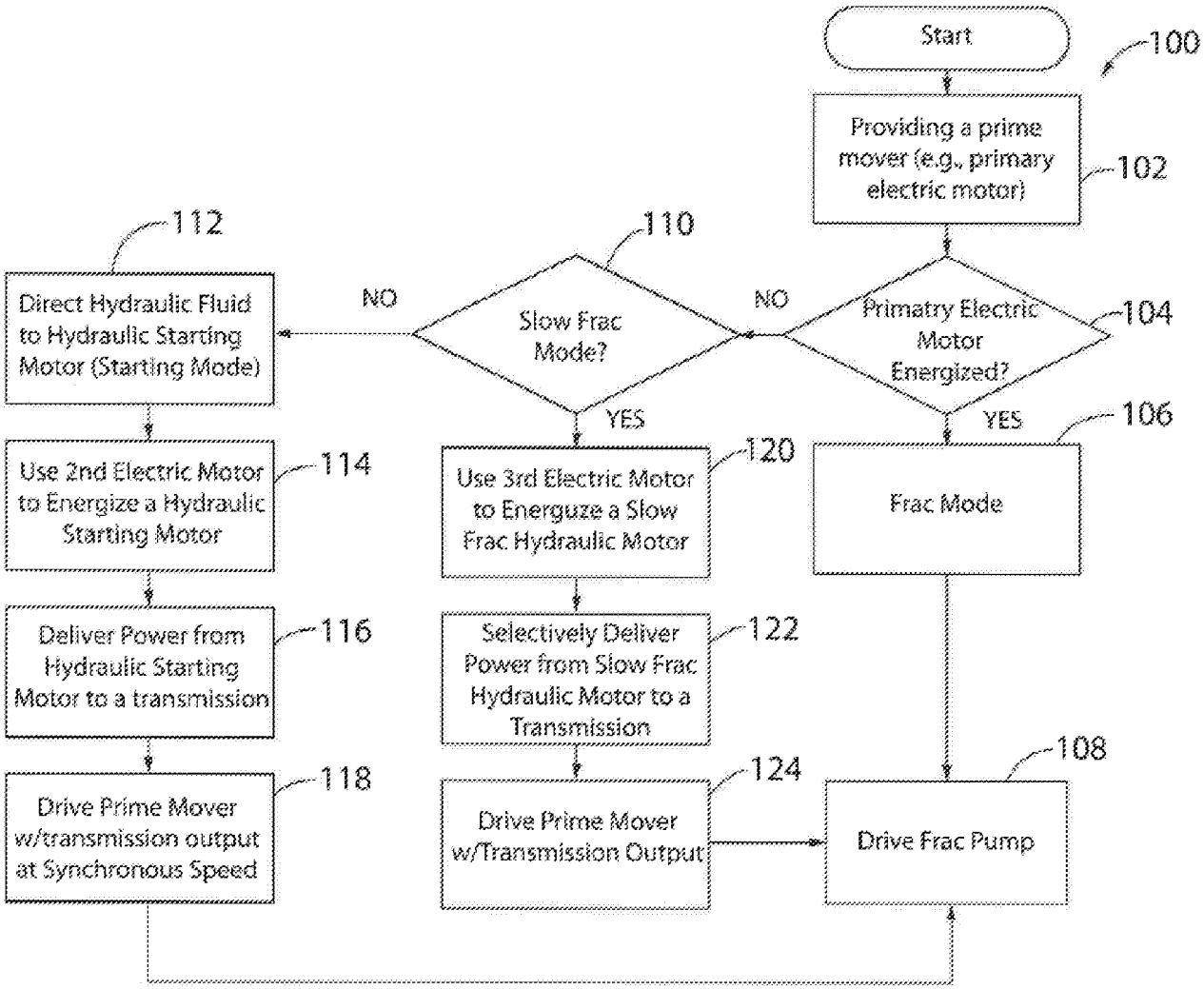
FIG. 4 is a flow chart illustrating a method of fracking according to the preferred embodiments.

A method 100 of fracking using the above-described systems of the preferred embodiments is set forth in FIG. 4. Method 100 includes providing one or more prime movers in Block 102. The prime movers in these embodiments are primary electric motors such as those described previously. In Block 104, the system determines if the primary electric motor is energized and, if so, maintains Frac Mode in Block 106. In Frac Mode, mode selector valve is held in a neutral position for default fracking while power is delivered from primary electric motor to drive one or more frac pumps in Block 108, typically through a transmission (44 in FIG. 2).

If, on the other hand, the primary electric motor is not energized, method 100 determines whether the user wants to engage Slow Frac Mode, in Block 110. If not, Method 100 directs hydraulic fluid to hydraulic starting motor in Block 112, Starting Mode. In Block 114, a second electric motor is employed to energize the hydraulic starting motor. Hydraulic starting motor delivers power to the transmission that selectively delivers power to the primary electric motor to bring it to its rated fixed or synchronous speed, allowing connection to the electrical power source DoL (Direct on Line) in Block 118. Once connected to the DoL, primary electric motor can drive the frac pump(s) of the system in Block 108.

In Slow Frac Mode, a third electric motor is employed to energize a slow frac hydraulic motor in Block 120. A clutch may be provided to selectively deliver power from the slow frac hydraulic motor to a transmission in Block 122. Again, the slow frac hydraulic motor delivers torque through the transmission to the primary electric motor for high pressure low speed fracking applications. More particularly, in Block 124, transmission output is used to drive the prime mover (i.e., primary electric motor) at slow, precisely controlled speeds. Prime mover output is then used to drive one or more frac pumps in Block 108.

Although the best mode contemplated by the inventors of carrying out the present invention is disclosed above, practice of the above invention is not limited thereto. It will be manifest that various additions, modifications, and rearrangements of the features of the present invention may be made without deviating from the spirit and the scope of the underlying inventive concept.

I claim:

1. An electro-hydraulic high-pressure oilfield pumping system for driving a fracturing (frac) pump configured to pressurize a frac fluid for delivery into a well that extends into a subterranean geological formation, comprising:

a primary electric motor that has a motor shaft and defines a prime mover of the electro-hydraulic high-pressure oilfield pumping system;

a transmission with multiple ranges that provide multiple drive ratios, the transmission arranged between and configured to deliver power from primary electric motor to the frac pump;

a starting motor selectively delivering power through the transmission to rotate the motor shaft of the primary electric motor; and wherein the starting motor is a hydraulic motor that defines a hydraulic starting motor.

2. The system of claim 1, wherein the primary electric motor is a constant speed AC (alternating current) motor that defines a fixed rated speed.

3. The system of claim 2, further comprising a second electric motor that delivers power to the hydraulic starting motor.

4. The system of claim 3, wherein:

the primary electric motor is a constant speed AC motor that defines a fixed rated speed; and the hydraulic starting motor is configured to rotate at a speed that corresponds to the fixed rated speed of the primary electric motor.

5. The system of claim 1, further comprising a slow frac motor selectively delivering power through the transmission to rotate the motor shaft of the primary electric motor.

6. The system of claim 5, wherein the slow frac motor is a hydraulic motor that defines a slow frac hydraulic motor.

7. The system of claim 6, further comprising a third electric motor that delivers power to the slow frac hydraulic motor.

8. The system of claim 7, wherein: the primary electric motor is a constant speed AC motor that defines a fixed rated speed, and the slow frac hydraulic motor is configured to rotate at a speed that is less than the fixed rated speed of the primary electric motor.

9. The system of claim 1, wherein the starting motor is a hydraulic starting motor configured to rotate the motor shaft of the primary electric motor at a first speed that corresponds to a fixed rated speed of the primary electric motor, and the system further comprises a slow frac hydraulic motor configured to rotate the motor shaft of the primary electric motor at a second speed that is less than the fixed rated speed of the primary electric motor.

10. The system of claim 9, further comprising:

a hydraulic power pack configured to selectively permit or prevent flow of hydraulic fluid to each of the hydraulic starting motor and the slow frac hydraulic motor.

11. The system of claim 10, wherein the power pack defines a wide selector valve, wherein the system includes three modes including primary electric motor starting mode, slow frac mode and frac mode.

12. An electro-hydraulic high-pressure oilfield pumping system, comprising:

a fracturing (frac) pump configured to pressurize a frac fluid for delivery into a well that extends into a subterranean geological formation;

a primary electric motor that has a motor shaft and defines a prime mover of the electro-hydraulic high-pressure oilfield pumping system;

a transmission with multiple ranges that provide multiple drive ratios, the transmission arranged between and configured to deliver power from primary electric motor to the frac pump;

a hydraulic starting motor selectively delivering power through the transmission to rotate the motor shaft of the primary electric motor;

a slow frac hydraulic motor selectively delivering power through the transmission to rotate the motor shaft of the primary electric motor;

a hydraulic power pack configured to selectively permit or prevent flow of hydraulic fluid to each of the hydraulic starting motor and the slow frac hydraulic motor for activating or deactivating the hydraulic starting motor and the slow frac hydraulic motor.

13. The system of claim 12, wherein the system defines:

a primary electric motor starting mode in which the hydraulic starting motor delivers power through the transmission to rotate the motor shaft of the primary electric motor to a first speed that corresponds to a fixed rated speed of the primary electric motor;

a slow frac mode in which the slow frac hydraulic motor delivers power through the transmission to rotate the motor shaft of the primary electric motor to a second speed that is less than the fixed rated speed to the primary electric motor; and a frac mode in which the primary electric motor is energized and delivers power through the transmission and to the frac pump.

14. A method of fracking a subterranean formation using a primary electric motor, the method including the steps of:

driving the primary electric motor with a starting motor;

driving a frac pump with an output of the primary electric motor to facilitate fracking the subterranean formation;

selectively delivering power from the primary electric motor to the frac pump using a transmission;

wherein the primary electric motor is a constant speed AC motor; and wherein the starting motor is a hydraulic starting motor and the method further comprises the step of, in a starting mode, driving the hydraulic starting motor with a second electric motor, and rotating a motor shaft of the primary electric motor with the hydraulic starting motor to a first speed that corresponds to a fixed rated speed of the primary electric motor.

15. The method of claim 14, further comprising connecting a DoL (direct on line) electrical power source to the primary electric motor to drive the primary electric motor in a frac mode.

16. The method of claim 14, further comprising the step of, in a slow frac mode, driving a slow frac hydraulic motor with a third electric motor, the slow frac hydraulic motor selectively delivering power through the transmission to rotate the motor shaft of the primary electric motor to a second speed that is less than the fixed rated speed of the primary electric motor.

17. The method of claim 16, further comprising hydraulically bypassing each of the hydraulic starting motor and the slow frac hydraulic motor during a normal frac mode.

18. The method of claim 16, further comprising selectively permitting or preventing flow of hydraulic fluid to each of the hydraulic starting motor and the slow frac hydraulic motor for activating or deactivating the hydraulic starting motor and the slow frac hydraulic motor.

* * * * *